US006962108B1

(12) United States Patent
Yu Chen

(10) Patent No.: US 6,962,108 B1
(45) Date of Patent: Nov. 8, 2005

(54) STRAP-GUIDING DEVICE FOR A STRAPPING PACKAGING APPARATUS

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 0 days.

(21) Appl. No.: 10/873,182

(22) Filed: Jun. 23, 2004

(51) Int. Cl.[7] ..... B65B 13/18; B21F 9/02

(52) U.S. Cl. ..... 100/6; 100/29; 100/32; 156/79; 156/579; 140/93.4; 53/592

(58) Field of Search ..... 100/6, 29, 30, 100/32, 33 R, 33 PB; 53/592; 140/93 R, 140/93.2, 93.4, 123.5, 123.6; 156/79, 494, 156/579, 580; 254/225

(56) References Cited

U.S. PATENT DOCUMENTS 1,969,115 A * 8/1934 Bergstrom ..... 254/216
2,779,566 A * 1/1957 Keeble ..... 254/250
5,116,453 A * 5/1992 Niedrig ..... 156/580
6,085,498 A * 7/2000 Hua ..... 53/592
6,206,053 B1 * 3/2001 Hillegonds ..... 140/123.6

* cited by examiner

*Primary Examiner*—Derris H. Banks
*Assistant Examiner*—Jimmy T. Nguyen
(74) *Attorney, Agent, or Firm*—Troxell Law Office, PLLC

(57) ABSTRACT

A strap-guiding device for a strapping packaging apparatus includes a main body provided with a tightening device, a cutting device and a strap-compressing device. A nose-tip shaped base having a lower and an upper propping member is secured on the front wall of the main body, having a strap-inserting groove formed between the upper and the lower propping member. During packaging, a packaging strap has one end inserted through the strap-inserting groove of the nose-tip shaped base and passing through the cutting device and the tightening device, having the other end compressed and fixed by the strap-compressing device, and the nose-tip shaped base has its front end closely pushing against an article to make the packaging strap pulled and moved steadily and smoothly.

4 Claims, 5 Drawing Sheets

STRAP-GUIDING DEVICE FOR A STRAPPING PACKAGING APPARATUS

BACKGROUND OF THE INVENTION

1. Field of the Invention

This invention relates to a strap-guiding device for a strapping packaging apparatus, particularly to one having a nose-tip shaped base secured on the front wall of a strapping packaging apparatus. In a packaging process, the nose-tip shaped base can closely push against an article being packaged and correctly guide a packaging strap to be inserted through the strap entrance of a cutting device, able to carry out strap packaging steadily and smoothly.

2. Description of the Prior Art

A conventional strapping packaging apparatus 10, as shown in FIG. 1, includes a main body 11 provided thereon with a cutting device 12, a tightening device 13 and a strap-compressing device 14 orderly arranged from the front to the rear. The main body 11 is further provided with a press lever 15 at the upper side. Thus, after a packaging strap is wound around an article, one end of the packaging strap is inserted through under the strap-compressing device 14 to be compressed in position, and the other end is inserted through the strap entrance 121 of the cutting device 12 and the strap-inserting groove 131 of the tightening device 13. Subsequently, the press lever 15 is properly pulled to actuate the device 13 to turn and roll up the packaging strap backward and pull it tight, and then the press lever 15 is pressed downward to actuate the cutting device 12 to cut off the packaging strap.

However, in a packaging process, the strap entrance 121 of the cutting device 12 of the conventional strapping packaging apparatus 10 cannot closely contact with the article being packaged; therefore, when the packaging strap is pulled tight to finish packaging, a portion of the packaging strap abutting against the strap entrance of the cutting device 12 cannot completely tighten the article, always leaving a gap between the packaging strap and the article and hence failing to obtain firm tightness of packaging. In addition, the cutting device 12 of the conventional strapping packaging apparatus 10 is provided with no strap-guiding device; therefore, a packaging strap cannot smoothly be inserted through the strap entrance 121 of the cutting device 12, nor can it be pulled tight steadily.

SUMMARY OF THE INVENTION

The objective of the invention is to offer a strap-guiding device for a strapping packaging apparatus, which has a main body provided thereon with a tightening device at one side, a cutting device and a strap-compressing device respectively positioned before and behind the tightening device. The main body has its front end secured with a nose-tip shaped base composed of a lower propping member and an upper propping member, with a strap-inserting groove formed between the upper and the lower propping member. During packaging, a packaging strap has one end inserted through the strap-inserting groove of the nose-tip shaped base and then orderly passing through the cutting device and the tightening device, and has the other end compressed and fixed by the strap-compressing device.

The feature of the invention is the nose-tip shaped base able to closely push against an article being packaged so that when a packaging strap is pulled tight for packaging, it can completely and closely tighten the article without any gap left therebetween. The nose-tip shaped base is provided with a strap-inserting groove and a slanting-up strap-guiding surface, able to correctly guide the packaging strap to move to the strap entrance of the cutting device, pulled tight steadily and smoothly for carrying out packaging.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
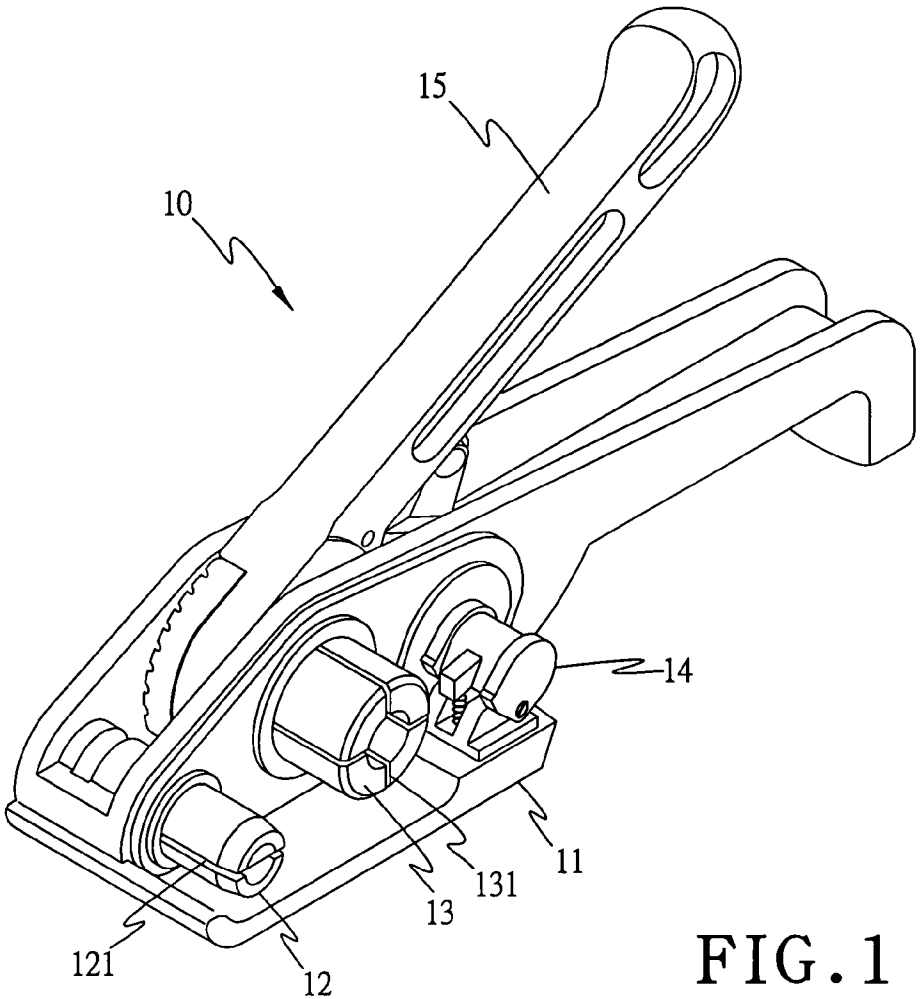
FIG. 1 PRIOR ART
FIG. 1 is a perspective view of a conventional strapping packaging apparatus.
Figure 2:
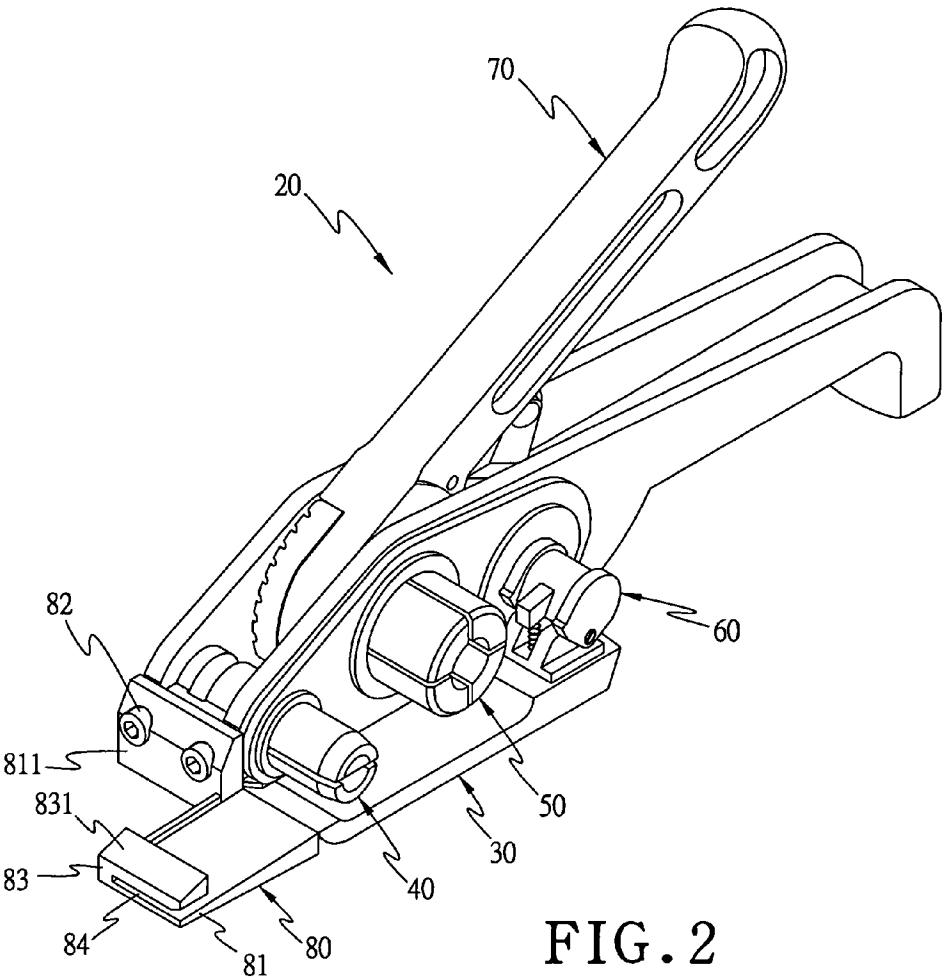
FIG. 2 is a perspective view of a strapping packaging apparatus in the present invention.
Figure 3:
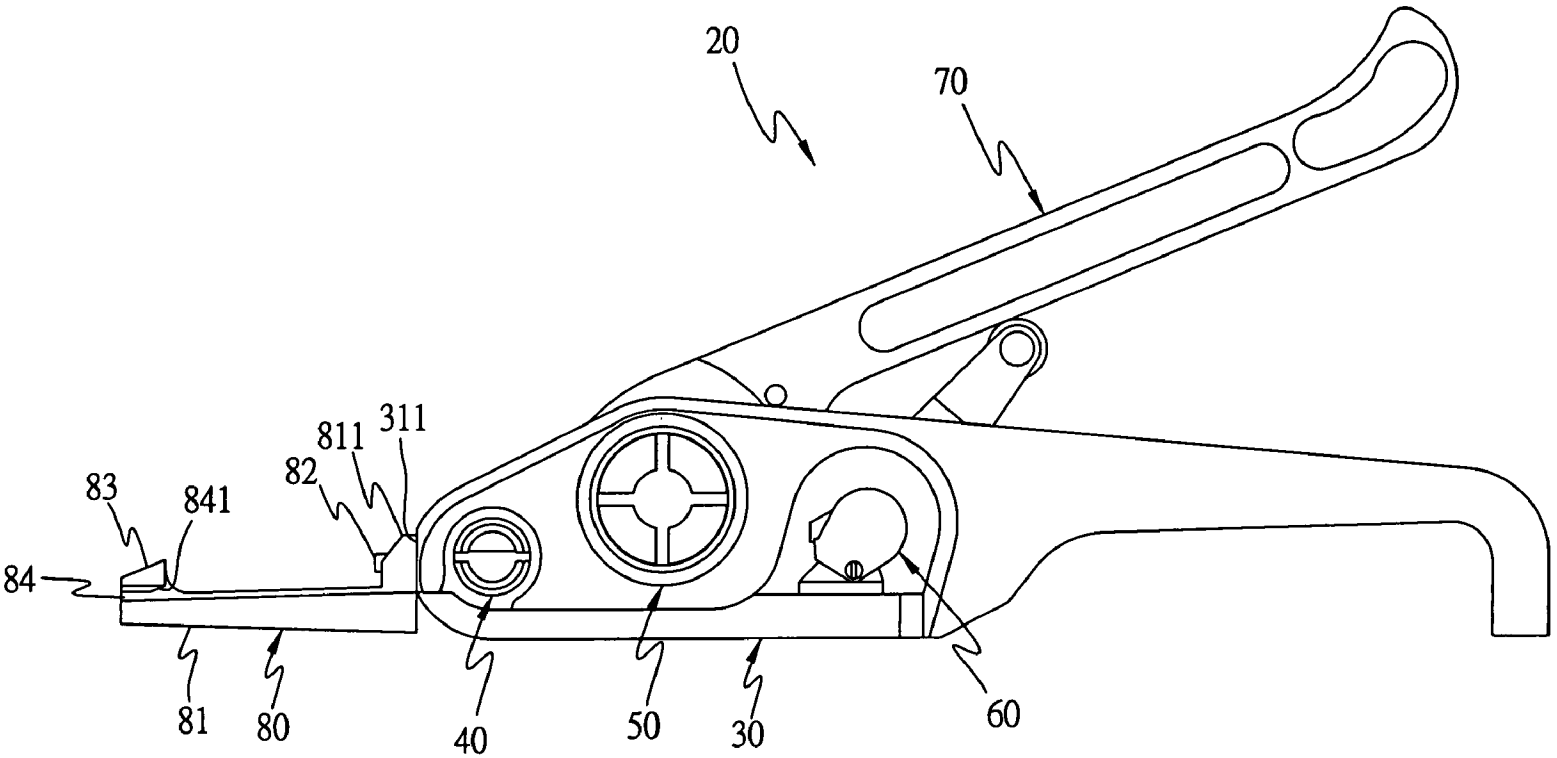
FIG. 3 is a side cross-sectional view of the strapping packaging apparatus in the present invention.
Figure 4:
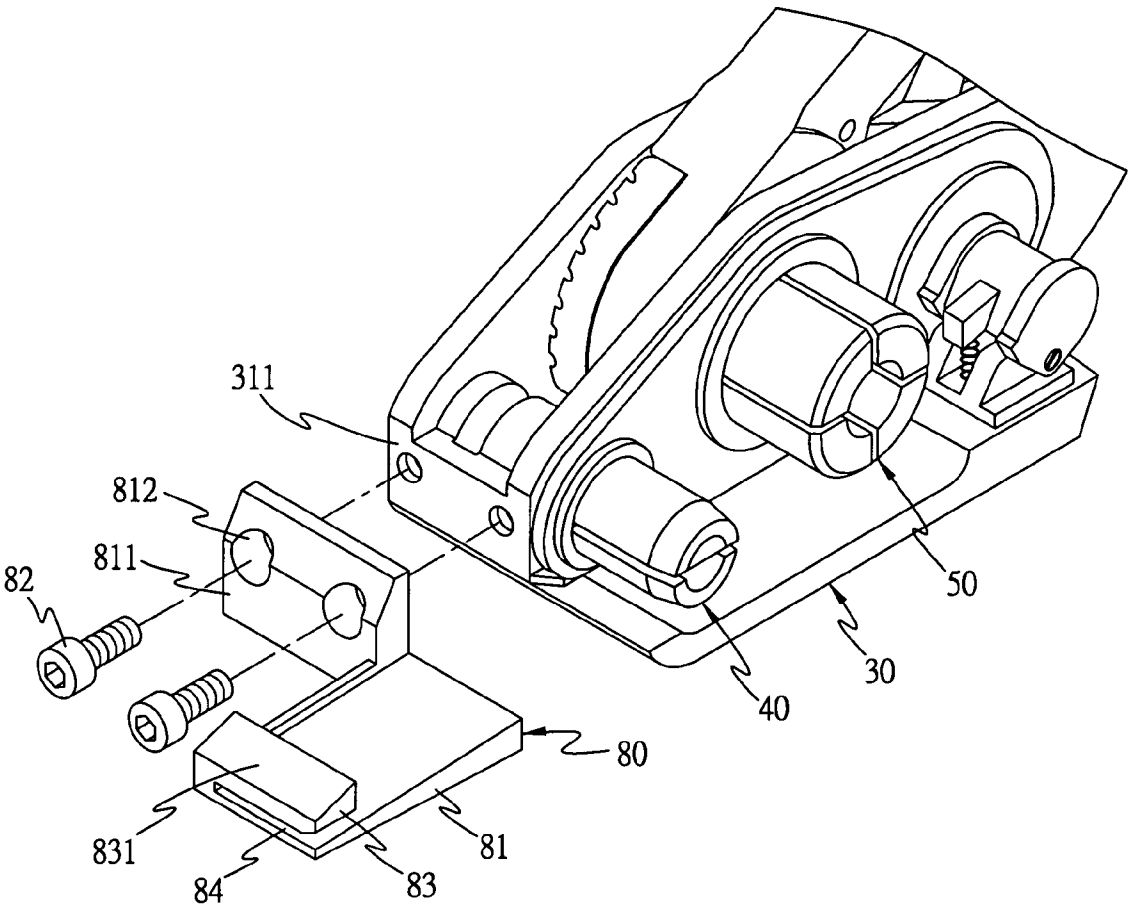
FIG. 4 is an exploded perspective view of the nose-tip shaped member of the strapping packaging apparatus in the present invention.

A preferred embodiment of a strap-guiding device for a strapping packaging apparatus in the present invention having a similar structure as the conventional one described above, as shown in FIGS. 2 and 3, includes a main body 30, a cutting device 40, a tightening device 50, a strap-compressing device 60, a press lever 70 and a nose-tip shaped member 80 combined together.

The main body 30 has one side provided thereon with the cutting device 40, the tightening device 50 and the strap-compressing device 60 orderly positioned from the front to the rear. The main body 30 is further provided with a press lever 70 at the upper side to be pressed to actuate the cutting device 40, the tightening device 50 and the strap-compressing device 60 to function.

The nose-tip shaped member 80 is provided with a lower propping member 81 having one side of its rear end extending sideward and forming a combining member 811 having two insert holes 812 for two locking bolts 82 to be respectively inserted therethrough so as to fix the combining member 811 on the front wall 311 of the main body 30. The lower propping base 81 has one side of its front end extending and bent into an upper propping base 83 facing the front end of the lower propping base 81, with a strap-inserting groove 84 formed between the lower and the upper propping base 81, 83. The upper propping base 83 has the rear upper wall of the strap-inserting groove 84 formed with a strap-guiding surface 841 slanting upward for 15 to 50 degrees, and has its topside formed with a strap guiding surface 831 slanting backward and upward for a preset angle.

Figure 5:
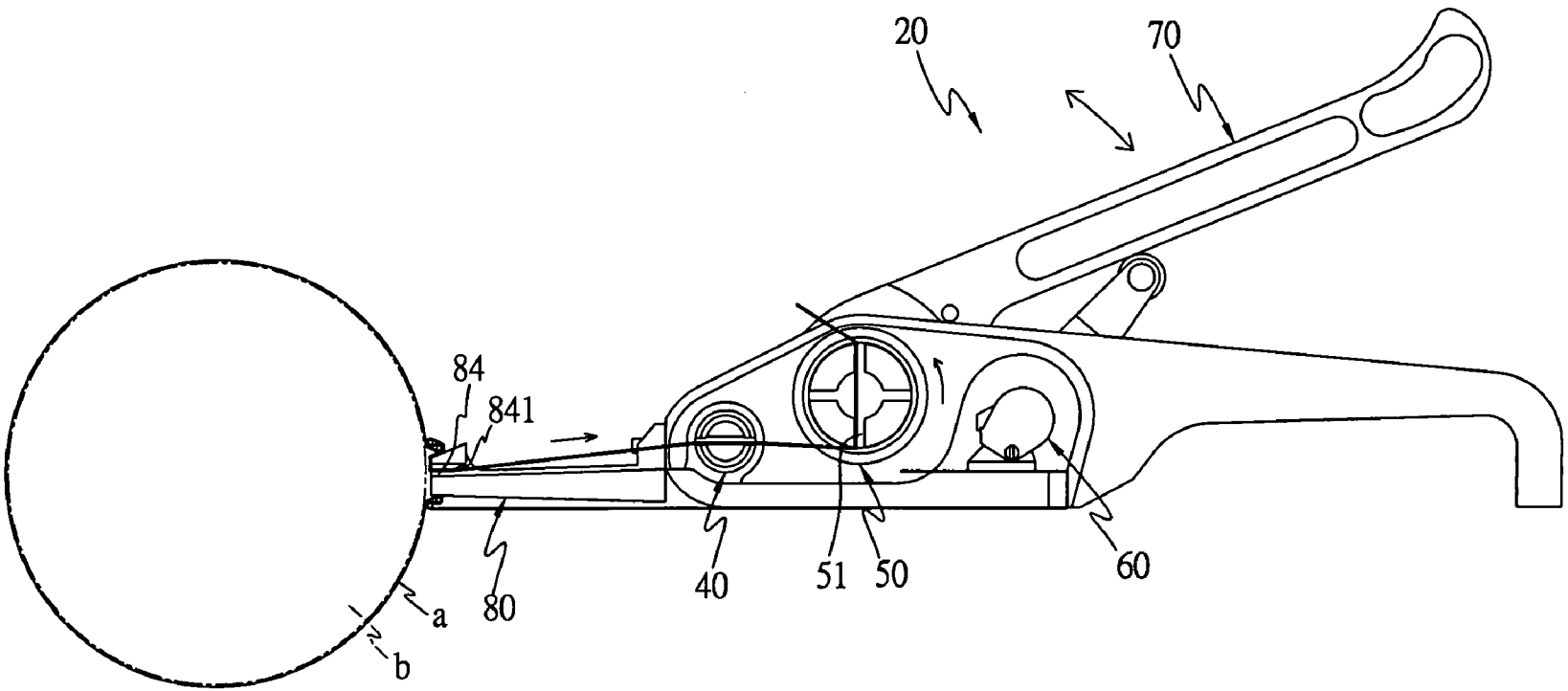
FIG. 5 is a side cross-sectional view of the strapping packaging apparatus in a strapping condition in the present invention.

In using, as shown in FIG. 5, after a packaging strap (a) is wound around an article (b), one end of the packaging strap (a) is inserted through under the bottom of the strap-compressing device 60 to be compressed in position, and the other end is orderly inserted through the strap-inserting groove 84 of the nose-tip shaped member 80 and through the strap entrance of the cutting device 40 as well as the strap-inserting groove 51 of the tightening device 50. Then, the press lever 70 is pulled and turned to actuate the tightening device 50 to rotate and pull backward the packaging strap (a) for carrying out packaging. In a packaging process, the nose-tip shaped member 80 has its front end closely pushing against the article (b) being packaged so as to make the packaging strap (a) completely and closely tighten the article (b) without any gap left therebetween. In addition, the strap-inserting groove 84 and the slanting-up strap-guiding surface 841 of the nose-tip shaped member 80 are able to correctly guide the packaging strap (a) to move in the strap entrance 41 of the cutting device 40, enabling the packaging strap (a) to be pulled and moved steadily and smoothly.

As can be understood from the above description, this invention has the following advantages.

1. During packaging, the nose-tip shaped member 80 has its front end closely pushing against the article (b) to avoid forming a gap between the packaging strap (a) and the article (b) after finishing packaging, able to elevate firmness of a packaged article.

2. The nose-tip shaped member 80 is provided with the strap-inserting groove 84 and the slanting-up strap-guiding surface 841; therefore, after the packaging strap (a) is inserted through the strap-inserting groove 84, it can correctly move to the strap entrance of the cutting device 40 along the strap-guiding surface 841 and be pulled steadily and smoothly by the tightening device 50.

While the preferred embodiment of the invention has been described above, it will be recognized and understood that various modifications may be made therein and the appended claims are intended to cover all such modifications that may fall within the spirit and scope of the invention.

I claim:

1. A strap-guiding device for a strapping packaging apparatus comprising a main body having one side provided thereon with a cutting device, a tightening device and a strap-compressing device, said main body provided with a press lever at an upper side, said press lever pulled and turned to actuate said cutting device and said tightening device and said strap-compressing device to function, a nose-tip shaped base secured at a preset location of a front wall of said main body, said nose-tip shaped base having a lower propping member, said lower propping having one side of its front end extending and bent to form an upper propping member facing said lower propping member, with a strap-inserting groove formed between said lower and said upper propping members for a packaging strap to pass therethrough, said packaging strap having one end inserted through said strap-inserting groove and then passing through said cutting device and said tightening device, during packaging said nose-tip shaped base having its front end closely pushing against an article being packaged, said strap-inserting groove of said nose-tip shaped base able to guide said packaging strap to move forward smoothly, wherein said lower propping member of said nose-tip shaped base has one side of its rear end extending sideward and forming a combining member having two insert holes for two locking bolts to be respectively inserted therethrough to fix said nose-tip shaped base at said preset location of the front wall of the main body, said lower propping member having said one side of its front end bent and extending horizontally to form said upper propping member, said strap-inserting groove formed between said upper and said lower propping members.

2. The strap-guiding device for a strapping packaging apparatus as claimed in claim 1, wherein said upper propping member of said nose-tip shaped base has a rear upper wall of said strap-inserting groove formed with a strap-guiding surface slanting upward for a preset angle.

3. The strap-guiding device for a strapping packaging apparatus as claimed in claim 2, wherein said slanting-up strap-guiding surface preferably slants upward for 15 to 50 degrees.

4. The strap-guiding device for a strapping packaging apparatus as claimed in claim 1, wherein said upper propping member of said nose-tip shaped base has its topside slanting both backward and upward for a preset angle.

* * * * *